United States Patent [19]

Biggins

[11] 4,042,143

[45] Aug. 16, 1977

[54] DOUBLE SEAL CONTAINER

[76] Inventor: Robert B. Biggins, 4230 Wiedenmann Place, Kansas City, Mo. 64111

[21] Appl. No.: 671,622

[22] Filed: Mar. 29, 1976

[51] Int. Cl.[2] ..... B65D 51/18; B65D 41/16

[52] U.S. Cl. ..... 220/256; 220/306

[58] Field of Search ..... 220/256, 257, 306, 23, 220/307, 355

[56] References Cited

U.S. PATENT DOCUMENTS

| | | | |
|---|---|---|---|
| 3,070,275 | 12/1962 | Bostrom | 220/23 X |
| 3,096,897 | 7/1963 | Hansen | 220/306 X |
| 3,567,064 | 3/1971 | Churan | 220/256 |
| 3,609,263 | 9/1971 | Clementi | 220/306 |
| 3,955,006 | 5/1976 | Sokolsky et al. | 220/256 X |

*Primary Examiner*—William Price
*Assistant Examiner*—Steven M. Pollard
*Attorney, Agent, or Firm*—Fishburn, Gold & Litman

[57] ABSTRACT

A double seal container for perishable foods and the like, comprising a base having upstanding side walls attached thereto and forming a receptacle with a wide mouth opening. The side walls include a seat portion disposed adjacent to an upper free edge thereof and having a smooth, frusto-pyrmidal surface adapted for forming a tapered seal. A removable snap-fitting lid closes the receptacle opening and forms a first airtight seal for the container. A seal plug having a smooth frusto-pyrmidal surface is pressed wedgingly into the seat portion and the cooperating frusto-pyrmidal surfaces of the seat portion and seal plug engage each other thereby forming a second container seal therebetween. The lid detachably retains the seal plug and the receptacle in a sealed position and the seal plug is provided with a recessed inner body portion whereby the seal plug when separated from the remainder of the container forms a bowl particularly adapted for serving therein the container's contents.

3 Claims, 4 Drawing Figures

DOUBLE SEAL CONTAINER

This invention relates to containers for material and in particular to double seal containers having a portion thereof particularly adapted for receiving a portion of said material therein.

The principal objects of the present invention are: to provide a container for perishable foods comprising a first snap-fitting seal and a second frusto-pyrmidal seal for greatly extended shelf life; to provide such a container wherein the closure detachably retains the receptacle and the seal plug in a sealed position; to provide such a container wherein a closure has means on same for snap-fitting a seal plug thereto for the convenient removal thereof from the container; to provide such a container wherein a seal plug base section is formed into a dish shape, the bottom of which being disposed adjacent the closure, whereby the seal plug when separated from the remainder of the container forms a bowl particularly adapted for serving food or the like from the container; to provide such a container wherein an imperforate cover sheath or membrane is disposed about the seal plug overlying the base and side walls thereof, whereby the sheath protects the seal plug from contact with wet foods; to provide such a container wherein the closure top portion includes a recessed annular portion adapted to receive therein the bottom of a like container for the secure stacking of a plurality of such containers; to provide such a container wherein the receptacle side walls include a circumferentially resilient portion for securing the second container seal; and to provide such a container which is economical to manufacture, efficient in use and capable of a long life and particularly adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

Figure 2:
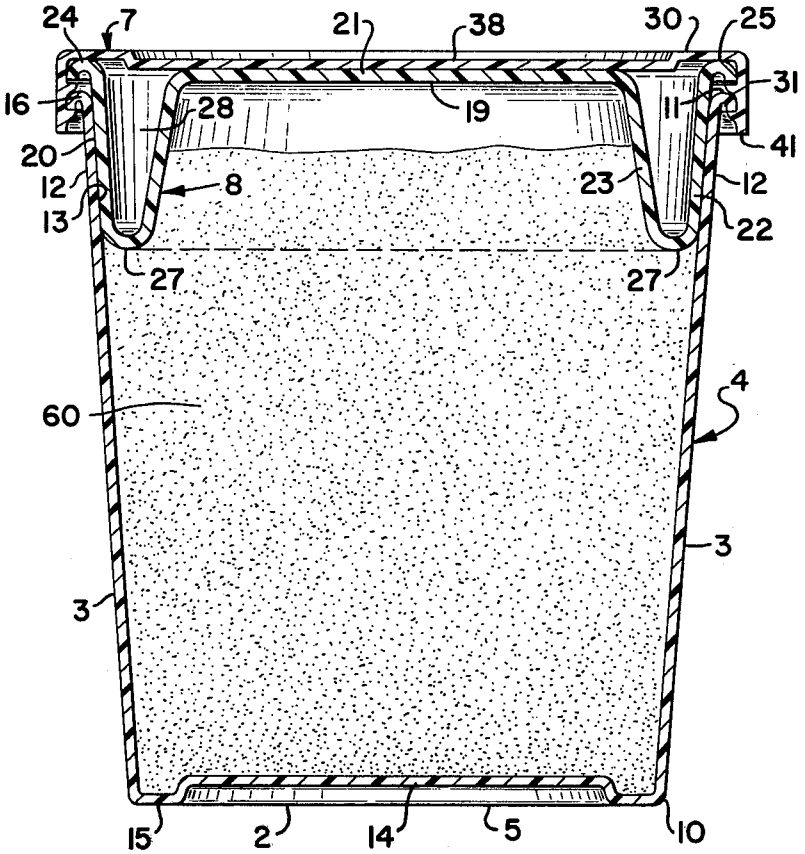
FIG. 2 is a vertical cross-sectional view of the container, taken axially therethrough and shown with contents such as food therein.
Figure 1:
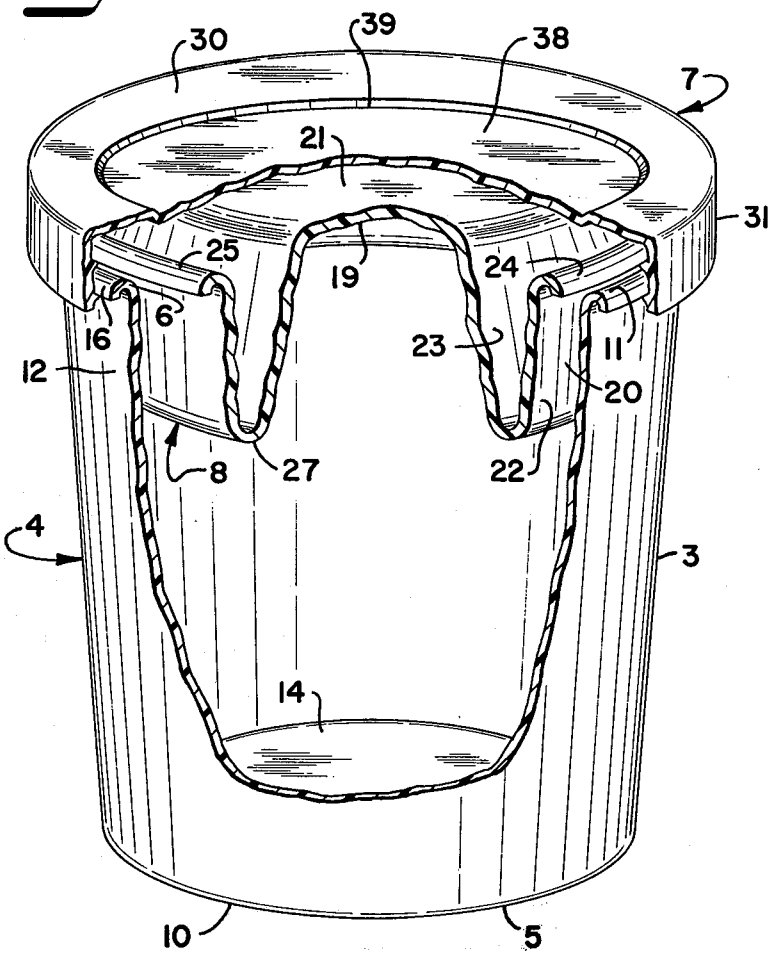
FIG. 1 is a perspective view of a double seal container embodying the present invention having portions thereof broken away to show the container's interior structure.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a container embodying the present invention, having a base 2, and upstanding side walls 3 attached thereto which form a wide-mouthed receptacle 4 having a closed end 5 and an open end 6. A removable snap-fitting closure 7 forms a first container seal about open end 6, and a seal plug 8 disposed within the container, forms a second container seal comprising the tapered engagement of a portion of same with an upper cooperating portion of the container side walls 3. The closure 7 detachably retains the receptacle 4 and the seal plug 8 in a sealed position.

The receptacle 4 being comprised of integrally attached base 2 and side walls 3, has a lower edge 10, an upper free edge 11, and a seat portion 12 disposed adjacent to the free edge, said seat portion having a smooth frusto-pyrmidal surface 13 adapted to seal with plug 8. In the illustrated structure, surface 13 is frusto-conical, base 2 is circular and the side walls 3 diverge slightly and regularly from the base 2 to the free edge 11 such that the seat portion is coincident with the side walls 3. Further, the base 2 is provided with a circularly shaped indentation 14 therein forming an annular foot or ring 15 on which the container sets. The ring 15 provides additional stacking stability by concentrating the weight of the container and contents thereof toward the outer edge 10 of the receptacle. A lip portion 16 is provided adjacent the upper free edge 11 and is adapted for sealing engagement with a first portion of the closure 7. In the illustrated structure, the lip 16 is resilient so as to improve the integrity of the first container seal, and includes outer surface 17 and end edge 18.

The seal plug 8 has a body 19 with a smooth, frusto-pyrmidal, outer surface 20 being adapted for cooperating engagement with surface 13 of the receptacle seat portion 12. A base 21 connects the body outer surface 20 about its inner periphery, thereby forming a structure which when pressed into said seat portion forms an airtight, tapered seal therewith. In the illustrated container, surface 20 is frusto-conical and the base 21 is integrally formed with upstanding exterior side wall 22 and interior side wall 23. The exterior side wall 22 is smooth and conically shaped so as to sealingly mate with the seat portion 12 of the receptacle 4, and is provided with a lip portion 24 adjacent the free edge 25 thereof. The lip 24 has an edge 26, is adapted to engage a second portion of the closure, and is preferably resilient for improved fastening therewith. The interior side wall 23 tapers convergingly toward exterior side wall 22 from base 21 to the rounded intersection 27 thereof, thereby forming a recess or hollow portion in the form of a dish which when separated from the remainder of the container forms a bowl particularly adapted for serving the contents thereof. In the illustrated seal plug, the upper surface of the base 21 is disposed below free edge 25, so that when used as a bowl, the seal plug will set securely and evenly on any flat surface. Also, the base 21 and walls 22 and 23 are preferably formed from a single sheet of material or are molded with an aperture 28 between said wall portions to minimize body thickness and thereby reduce transportation weight and material cost.

The closure 7 is comprised of a circular top portion 30 having a flange 31 depending normally therefrom and being attached integrally therewith. The flange 31 includes a first or receptacle lip bead 32 and a second or seal plug lip bead 33, both of which are illustrated as being formed integrally about an interior surface 34 of the flange. The beads 32 and 33 are mutually parallel and disposed a spaced distance apart. Each bead is suitably shaped for engaging the lips 16 and 24 and is shown having a first integrally formed side 35, a second flat side 36 disposed perpendicularly thereto, and a third curvilinear side 37 comprising a generally triangularly shaped bead which acts as a barb in engaging the lips. The distance between the flat side 36 of the first and second beads is determined in accord with the shape of the lips 16 and 24, such that when the closure is snapped onto the receptacle, a seal is formed between surfaces 17 and 34 and a gap 40 exists between side 36 of bead 33 and end edge 26 of seal plug lip 24. In the illustrated structure, the closure top 30 includes a recessed annular portion 38 adapted to receive therein the base 2 of a like container, with the lower edge 10 coincident with a lower edge 39 of the recess to facilitate the safe stacking of a plurality of such containers. The flange 31 includes an outer free edge 41 which is disposed a predetermined distance from the first bead 32 so as to provide a secure first container seal. In the illustrated structure, seal plug base 21 abuts the recessed portion 38 of closure top 30, thereby providing structural support therefor and improving the vertical stacking of several such containers on top of each other.

The receptacle 4, and the seal plug 8 are separately nestable with other like receptacles and seal plugs respectively to facilitate the storage of said members, prior to use. Also, each container member is preferably constructed of a light, moldable material, such as a synthetic resin plastic, water-proof fiberboard, or the like.

Figure 4:
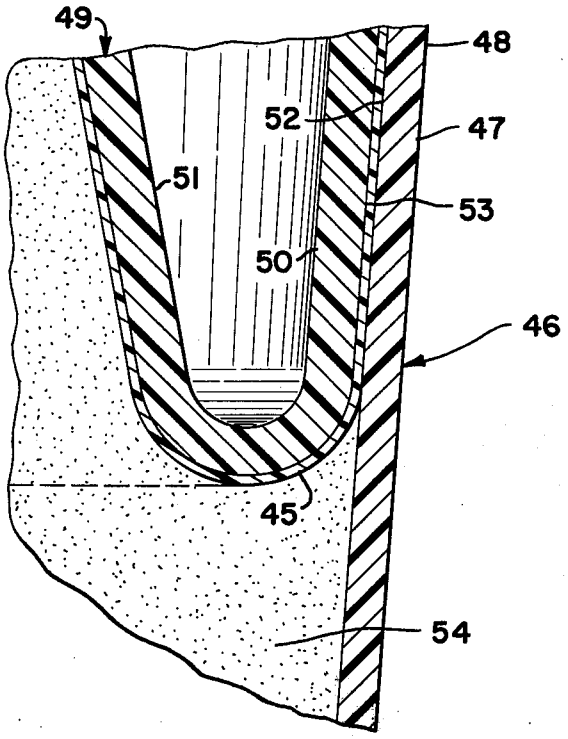
FIG. 4 is an enlarged fragmentary vertical cross-sectional view of another embodiment of the present invention, wherein a membrane is disposed overlying the interior sealing member of the container.
Figure 3:
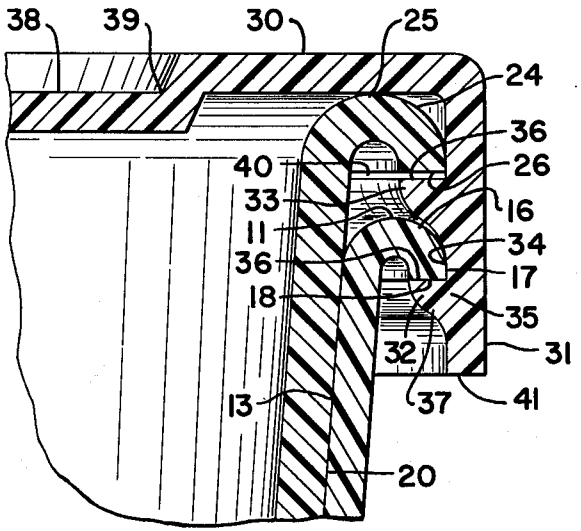
FIG. 3 is an enlarged fragmentary vertical cross-sectional view of the container, particularly showing the various cooperating container members.

Another embodiment of the present container includes a sheath or membrane 45 disposed about the conical seal 49 to protect same from contact with the contents 54 of the container. The container 46 illustrated in FIG. 4 is similar to the above described container and has receptacle side walls 47, seat portion 48, seal plug 49, with walls 50 and 51 and mating frustroconical surfaces 52 and 53. The membrane 45 is preferably formed from a thin, flexible, lightweight material such as a synthetic plastic, and is detachably fastened to the seal plug inner surface by means such as vacuum heat sealing. The membrane serves as a protective cover for the seal plug particularly when wet food 54 is transported in the container.

In use, the container 1 is filled with a substance such as pet food 60 or the like, to be preserved therein. The seal plug 8 is seated in the portion 12 of the receptacle, and wedgingly pressed therein to secure a tight tapered seal between the conically shaped surfaces 20 and 13 respectively thereof. The seat portion 12 preferably includes a circumferentially resilient portion to secure said tapered seal. The closure 7 is pressed over lip portions 16 and 24 of the receptacle and seal plug respectively, until each engages the respective bead 32 and 33 on the closure flange 31. Upon such engagement, the outer surface 17 of the lip 16 resiliently seals against the inner surface 34 of flange 31. Simultaneously, the engagement of end edge 18 of lip 16 with flat side 36 of the first bead 32 as well as free edge 25 with closure top 30, positively restrains divergent axial motion between the seal plug and the receptacle, thereby securing the second container seal. A plurality of such containers may be safely stacked upon one another through the use of receptacle depression 14 and closure top recessed portion 38. When the user desires to access the contents 60 of te container 1 he simply unsnappingly detaches the first bead 32 from lip 16 and lifts upwardly thereon, thereby separating the closure 7 and the seal plug 8 from the receptacle 4. The seal plug 8 may then be detached from closure 7 and placed base side 21 down upon a suitable surface and employed as a serving dish for the contents of the container. The closure 7 may then be placed back onto the receptacle 4 to seal same for future use.

The use of a container such as that illustrated in FIG. 4 is substantially identical to the above described use, with the exception that the membrane 45 is removed from the seal plug 49 prior to use thereof as a dish. The membrane 45 keeps the seal plug clean, sanitary, and ready for immediate use as a dish for serving therein the container contents 54.

It is to be understood that while I have illustrated and described certain forms of my invention, it is not to be limited to the specific forms or arrangement of parts herein described and shown.

What I claim and desire to secure by Letters Patent is:

1. A container comprising:

a. a base with upstanding side walls attached thereto forming a wide-mouthed receptacle for receiving perishable contents therein, said side walls having an upper free edge which defines a container opening and includes a seat portion disposed adjacent to said free edge, said seat portion having a smooth inner surface which tapers inwardly from said free edge;

b. a removable snap-fitting closure engaging the upper free edge of said receptacle and closing said opening to form a first container seal about said free edge, said closure being imperforate;

c. a seal plug having a smooth outer surface with a tapered shape for cooperating contact with said seat portion and being removably positioned within said receptacle, the outer surface of said seal plug and the inner surface of said seat portion cooperatively abutting each other during use to form a second container seal between said surfaces;

d. said closure engaging said seal plug and retaining the same in a sealed position in the receptacle seat portion;

e. said receptacle side walls include a first bead formed on an outside surface thereof at a point positioned adjacent to said free edge;

f. said closure includes a top portion and a flange portion depending substantially normally therefrom and integrally connected therewith;

g. said flange includes a second bead formed integrally around an interior surface thereof, said second bead engaging said first bead and removably connecting said closure and said receptacle;

h. said seal plug includes a base with upstanding side walls attached thereto, said seal plug side walls having an upper end edge abutting an interior surface of the closure top portion along a line disposed adjacent to said flange whereby said closure wedgingly urges said seal plug snugly into said seat portion and retains the same therein; and i. said seal plug base has a medial portion thereof in abutting contact with and supporting a medial portion of said closure to improve container packing and stacking efficiency.

2. A container as set forth in claim 1 wherein:

a. said seal plug includes a third bead formed on the outside surface thereof at a point disposed adjacent to the upper end edge of said seal plug; and b. said closure flange includes a fourth bead formed integrally around the interior surface thereof between said second bead and the top portion of said closure; said third bead engaging said fourth bead and removably connecting said seal plug and said closure.

3. A container comprising:

a. a base with upstanding side walls attached thereto forming a wide-mouthed receptacle for receiving perishable contents therein, said side walls having an upper free edge which defines a container opening and includes a seat portion disposed adjacent to said free edge, said seat portion having a smooth inner surface which tapers inwardly from said free edge;

b. a removable snap-fitting closure engaging the upper free edge of said receptacle and closing said opening to form a first container seal about said free edge, said closure being imperforate;

c. a seal plug having a smooth outer surface with a tapered shape for cooperating contact with said seat portion and being removably positioned within said receptacle, the outer surface of said seal plug and the inner surface of said seat portion cooperatively abutting each other during use to form a second container seal between said surfaces;

d. said closure engaging said seal plug and retaining the same in a sealed position in the receptacle seat portion;

e. said closure includes a top portion and a flange portion depending substantially normally therefrom and integrally connected therewith;

f. said receptacle side wall and said flange have cooperative engaging portions on adjacent surfaces removably connecting said closure and said receptacle;

g. said seal plug includes a base with upstanding side walls attached thereto, said seal plug side walls having an upper end edge abutting an interior surface of the closure top portion along a line disposed adjacent to said flange whereby said closure wedgingly urges said seal plug snugly into said seat portion and retains the same therein; and h. said seal plug base has a medial portion thereof in abutting contact with and supporting a medial portion of said closure to improve container packing and stacking efficiency.

* * * * *